US006006556A

United States Patent [19]

Daoud

[11] Patent Number: 6,006,556

[45] Date of Patent: Dec. 28, 1999

[54] HINGED SECURITY OVERRIDE SYSTEM WITH HIDDEN OVERRIDE MECHANISM

[75] Inventor: Bassel Hage Daoud, Parsippany, N.J.

[73] Assignee: Lucent Technologies Inc., Murray Hill, N.J.

[21] Appl. No.: 09/264,612

[22] Filed: Mar. 9, 1999

[51] Int. Cl.[6] ..... E05B 67/38

[52] U.S. Cl. ..... 70/56; 70/54; 70/159; 70/465; 292/251.5; 292/285

[58] Field of Search ..... 70/DIG. 57, 10, 70/12, 27, DIG. 43, DIG. 56, 46, 51, 54, 55, 56, 162, 159, 465; 292/251.5, DIG. 63, 251, 205, 207, 209, 285, DIG. 65, 206

[56] References Cited

U.S. PATENT DOCUMENTS

| | | | |
|---|---|---|---|
| 704,413 | 7/1902 | Weston | 292/1 |
| 716,118 | 12/1902 | Scott | 292/1 |
| 1,336,505 | 4/1920 | Buggeln | 292/1 |
| 1,806,031 | 10/1931 | Vignos | 70/81 |
| 1,961,041 | 5/1934 | Gilbert, Jr. | 292/148 |
| 2,825,218 | 3/1958 | O'Brien | 70/7 |
| 3,572,062 | 3/1971 | Beebe | 70/1.5 |
| 3,889,498 | 6/1975 | Harrell | 70/78 |
| 3,926,018 | 12/1975 | Joersz | 70/19 |
| 3,938,837 | 2/1976 | Bright | 292/149 |
| 4,085,599 | 4/1978 | Fischer et al. | 70/14 |
| 4,229,956 | 10/1980 | Thorburn | 70/129 |
| 4,284,300 | 8/1981 | Campbell | 292/251 |
| 4,290,281 | 9/1981 | Knaack et al. | 70/54 |
| 4,384,375 | 5/1983 | Gerome | 4/240 |
| 4,741,564 | 5/1988 | Alford | 292/285 |
| 4,782,675 | 11/1988 | Thorburn | 70/129 |
| 5,026,100 | 6/1991 | Hulkenberg, Jr. | 292/92 |
| 5,076,078 | 12/1991 | Weger, Jr. | 70/54 |
| 5,092,143 | 3/1992 | Rumbles | 70/56 |
| 5,312,266 | 5/1994 | Daoud | 379/445 |
| 5,315,849 | 5/1994 | Georgopoulos | 70/34 |
| 5,497,416 | 3/1996 | Butler, III et al. | 379/399 |
| 5,572,773 | 11/1996 | Bauer | 24/303 |
| 5,740,685 | 4/1998 | Daoud | 70/164 |
| 5,743,116 | 4/1998 | Suster | 70/14 |
| 5,875,659 | 3/1999 | Nosse | 70/56 |

*Primary Examiner*—Darnell M. Boucher
*Assistant Examiner*—John B. Walsh

[57] ABSTRACT

A security override system for a lockable enclosure comprising a hasp portion mounted to the enclosure and extending through an opening in an outer door of enclosure; a bracket mounted to the outer door, the bracket being movable between an open position and a closed position, the bracket having a fastening portion attached at one end thereof; the bracket mating with the hasp portion when in the closed position for forming a padlock receiving portion; the fastening portion being constructed and positioned to releasably engage a corresponding retention member mounted within the enclosure when the bracket is in the closed position; the bracket being immovable when the fastening portion is engaged with the retention member, the bracket being movable when the fastening portion is not engaged with the retention member.

16 Claims, 6 Drawing Sheets

HINGED SECURITY OVERRIDE SYSTEM WITH HIDDEN OVERRIDE MECHANISM

FIELD OF THE INVENTION

This invention relates to a security system for use with a junction box, a Building Entrance Protector, or any other lockable enclosure or container, and in particular, to a hinged security override system for permitting access to the enclosure when padlocked, without the need to unlock the padlock.

BACKGROUND OF THE INVENTION

Junction boxes have long been used to collect and protect telephone and electrical wires for distribution, splicing, cross connection and other uses. In the telephony arts, such wire junction boxes are more commonly known as network interface units (NIUs) and/or building entrance protectors (BEPs). Such containers are typically lockable.

In a telephone network, a network cable from the central office is connected to a BEP located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99-type connector block, such as are available from Lucent Technologies Inc. The customer telephone equipment is coupled through the connector block to a central office (CO) telephone line. The CO line side of the connector is generally the bottom side of the connector block, where the CO line tip-ring wire pairs are connected using a wire-wrapping tool.

The BEP generally has a lockable outer door to prevent unauthorized access to the components inside. The outer door is generally secured by a keyed or combination type padlock, and the building owner retains possession of the only key (or combination). Frequently, it is necessary for others in addition to the building owner to open the BEP for servicing or maintenance, for example, telephone company technicians or contractors acting in their capacity. Such servicing will at times occur during non-business hours or at other times when the building owner cannot be located or is not available. If the building owner is not available, the technician wishing to service the BEP would not be able to do so because the building owner has the only key to the padlock. The technician would then have to come back at a later date when the building owner was available, which is both inconvenient to the technician, and costly to the building owner and their customers. Also, if the key or combination to the padlock was lost, it would be necessary to saw off the padlock in order to access the components within the BEP. Accordingly, a mechanism for overriding the padlock is desired, while at the same time maintaining the appearance of a secure, locked utility box.

SUMMARY OF THE INVENTION

The present invention provides a hinged security override mechanism for accessing the components within a padlocked utility box or other enclosure without having to first unlock the padlock, while at the same time maintaining the appearance of a secure, locked utility box. The present invention, while described herein as preferably applied to such boxes as are used in the telephony arts, is, as will be seen from the disclosure herein, applicable to any lockable box, container, enclosure, or door thereof.

The mechanism consists of a generally U-shaped bracket which is hingeably mounted to the outside of the front door of the utility box. The bracket is hingeably mounted at one end and comprises a fastening portion at the other end. The fastening portion includes a threaded security screw or bolt mounted thereto. The bracket is hingeably movable between an open position and a closed position. A hasp is fixedly mounted to a rear wall within the utility box and extends through an opening in the outer door of the utility box to mate with the bracket at a point outside of the outer door. The bracket is constructed such that when in its closed position, it mates with the hasp to form what appears to be, and what acts as, a conventional padlock hasp with an opening to receive a padlock. When the outer door is closed and the bracket is in its closed position mating with the hasp, a padlock can be inserted through the hasp opening formed thereby in a conventional manner.

The hinged bracket is constructed such that when the bracket is in its closed position, the security screw of the fastening portion aligns with a corresponding threaded opening in a nut or other member attached to or otherwise mounted to a retention plate which is in turn mounted to an inside surface of the outer door. In a preferred embodiment, the fastening portion extends into a recess in the outer door of the utility box such that the fastening portion and/or the head of the security screw does not extend beyond the front surface of the outer door. When the security screw is threaded into the threaded opening attached to the retention plate, the interaction of the security screw with the threaded opening maintains the bracket in its closed position. Thus, when the security screw is engaged with the threaded opening, and the padlock is installed within the opening between the bracket and the hasp, the outer door cannot be opened without removing the padlock. However, the security mechanism can be overridden by the technician or building owner knowledgeable in its construction, facilitating the opening of the outer door without having to first unlock the padlock.

In a preferred embodiment, the recess and fastening portion of the hinged bracket is hidden from view by the means of a bumper or hinged magnetic label. The bumper is positioned on an outside surface of the outer door of the utility box so as to movably cover or hide the recess which accepts the fastening portion having the security screw mounted thereon. The bumper is movable and/or bendable about a notch between an extended position, wherein the bumper renders the recess and security screw hidden from view from outside the enclosure, and a bent position, wherein the security screw is visible and accessible from outside the utility box. That is, the bumper can be bent or otherwise moved so as to reveal the security screw. To add a further level of security, the security screw can be a specialized screw such as, for example, a KS/216 type combination screw. Also, the security screw can be constructed such that to the untrained eye it appears as merely an ordinary screw or bolt serving no apparent hidden purpose. That is, the outer door of the utility box can be constructed with a number of similar or identical looking screws to further maintain the secret function of the security screw. In any event, once the security screw is accessible, by turning the security screw with an appropriate tool, the security screw can be unthreaded from the corresponding threaded opening. Once the security screw is fully unthreaded, the bracket can then be hingeably moved to its open position, wherein the outer door can be opened. Thus, while the utility box looks as though it cannot be opened without unlocking the padlock, the technician knowledgeable in its construction can open the utility box without unlocking the padlock. Also, should the key to the padlock become lost, the building owner can open the utility box without having to cut off the padlock.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

Figure 5:
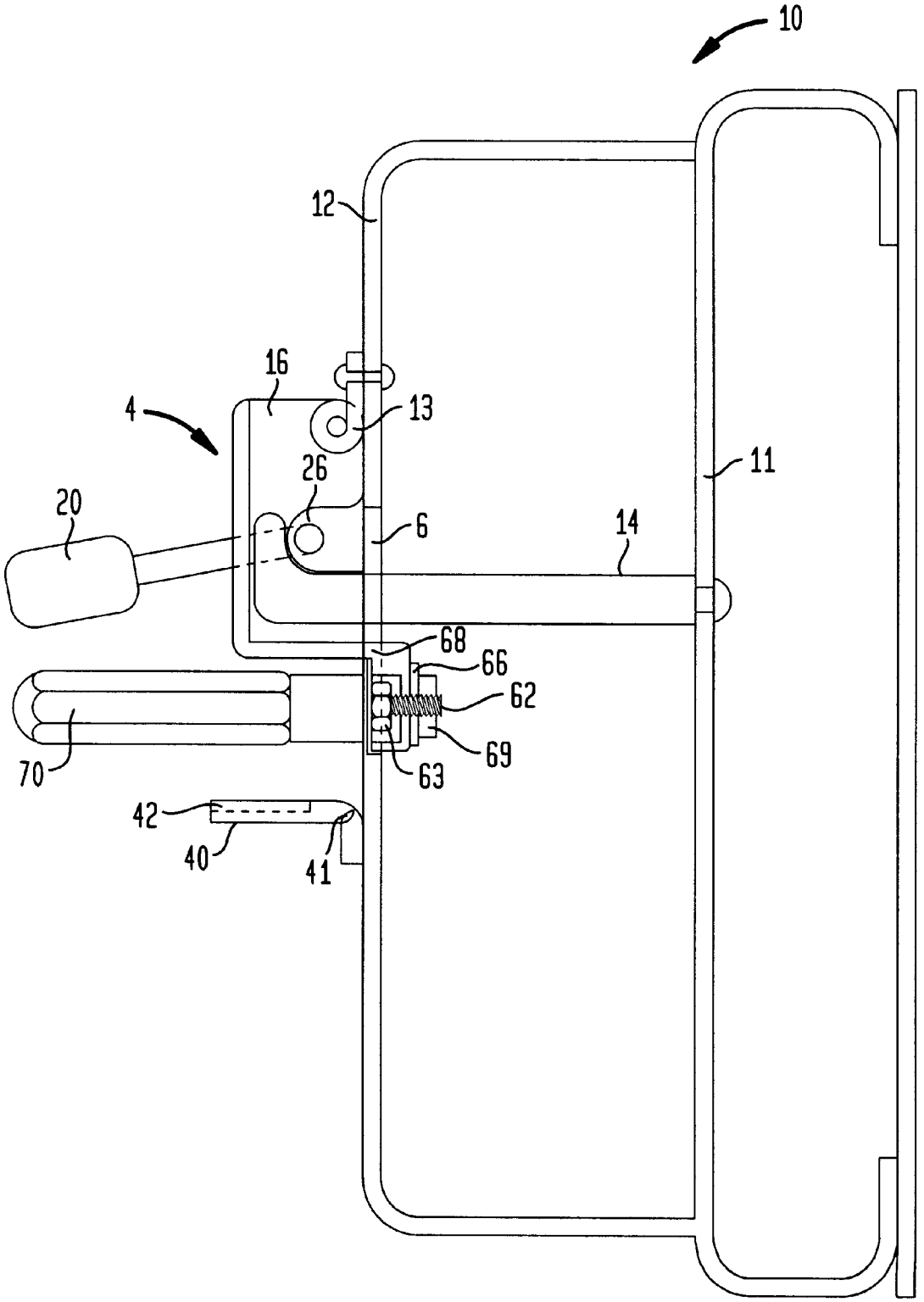
Figure 6:
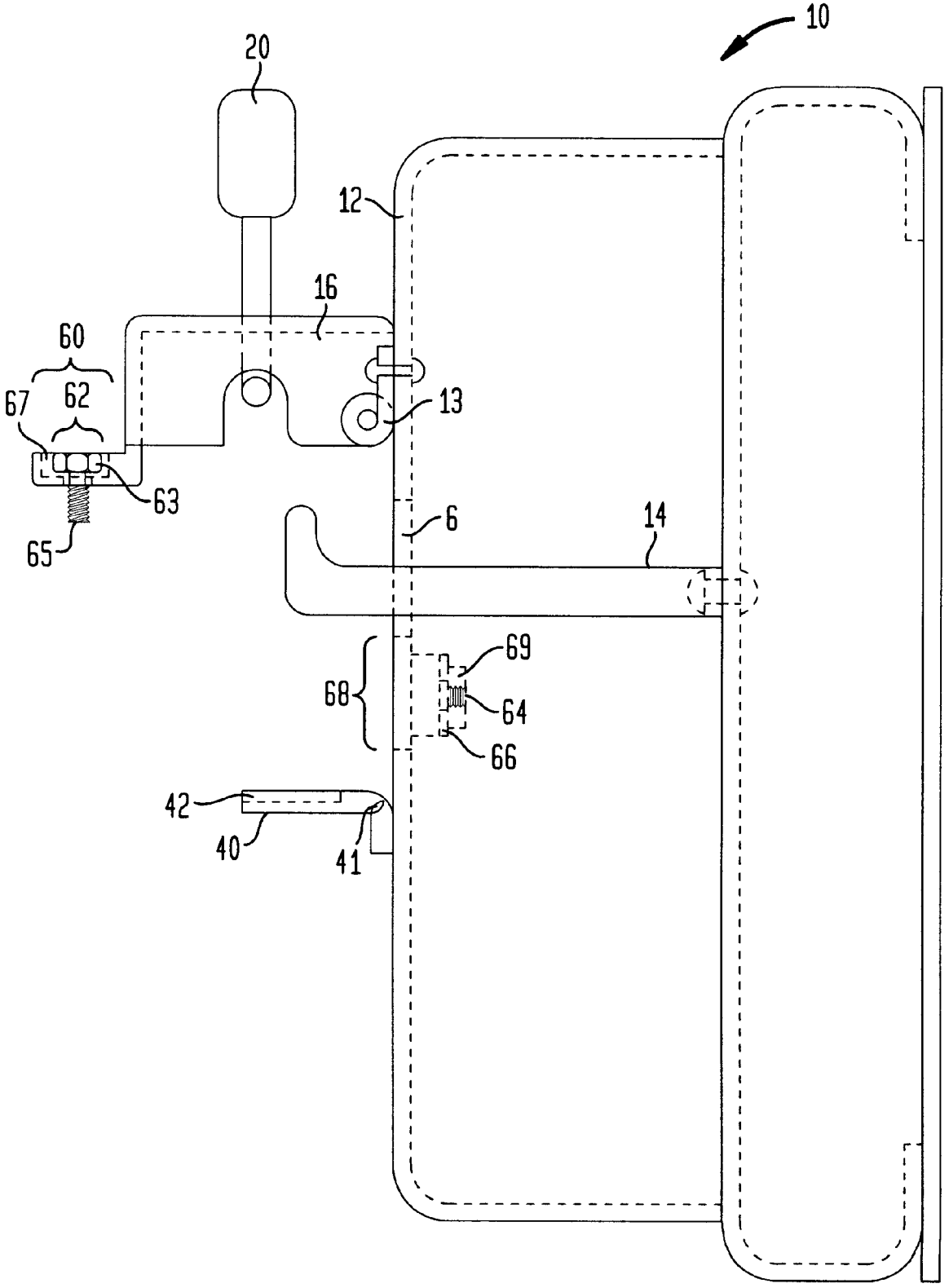

FIG. 5 is a side sectional view of the security override system constructed in accordance with a preferred embodiment of the present invention mounted to a utility box and with the magnetic label in its bent position and with a tool engaging the security screw; and FIG. 6 is a side sectional view of the security override system constructed in accordance with a preferred embodiment of the present invention mounted to a utility box and with the system in its open and unlocked position.

DETAILED DESCRIPTION OF THE PREFERRED EMBODIMENTS

Figure 2A:
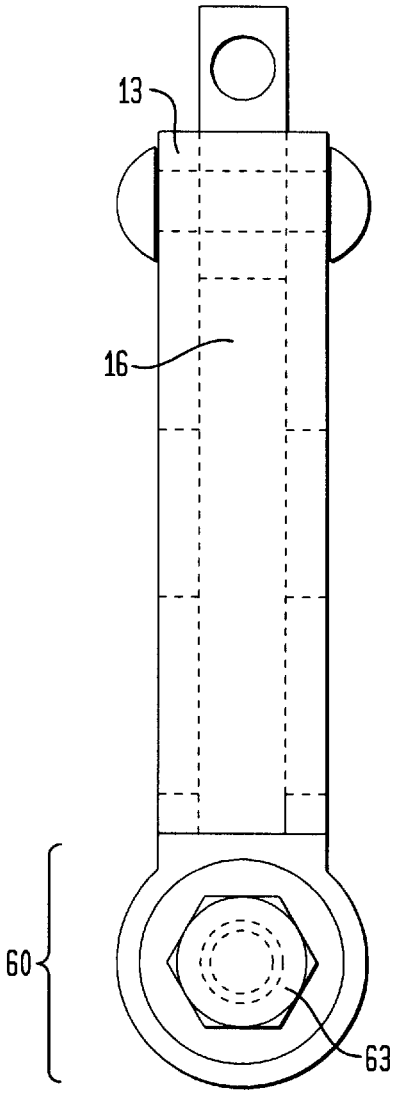
FIG. 2A is a front elevational view of a hinged bracket constructed in accordance with a preferred embodiment of the present invention.
Figure 2B:
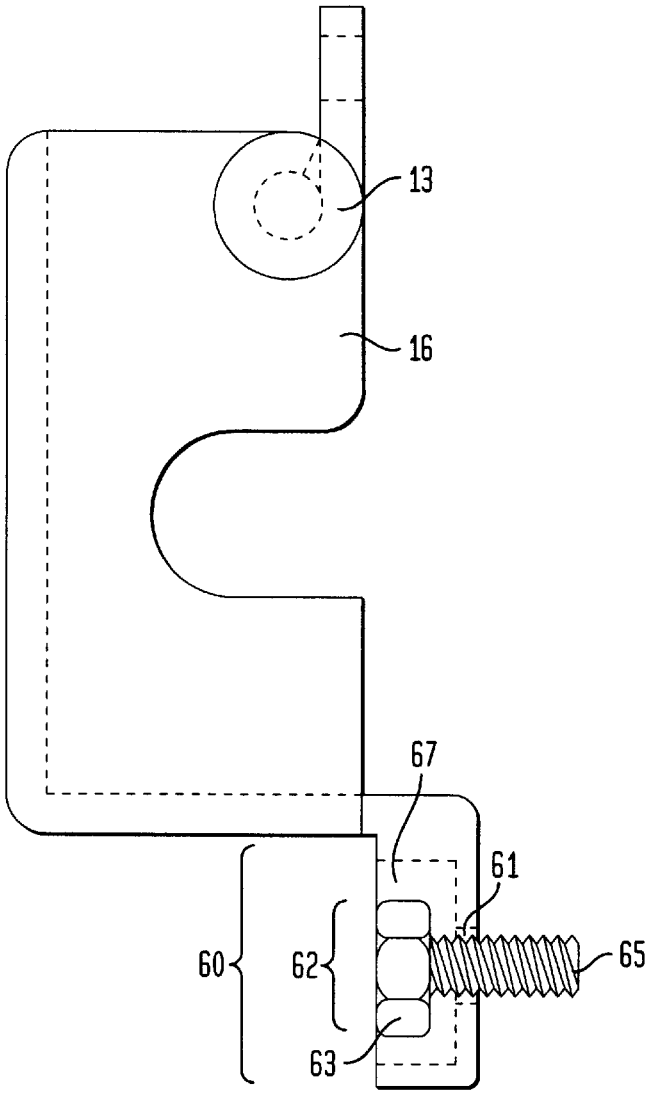
FIG. 2B is a side view of the hinged bracket of FIG. 3A.
Figure 3:
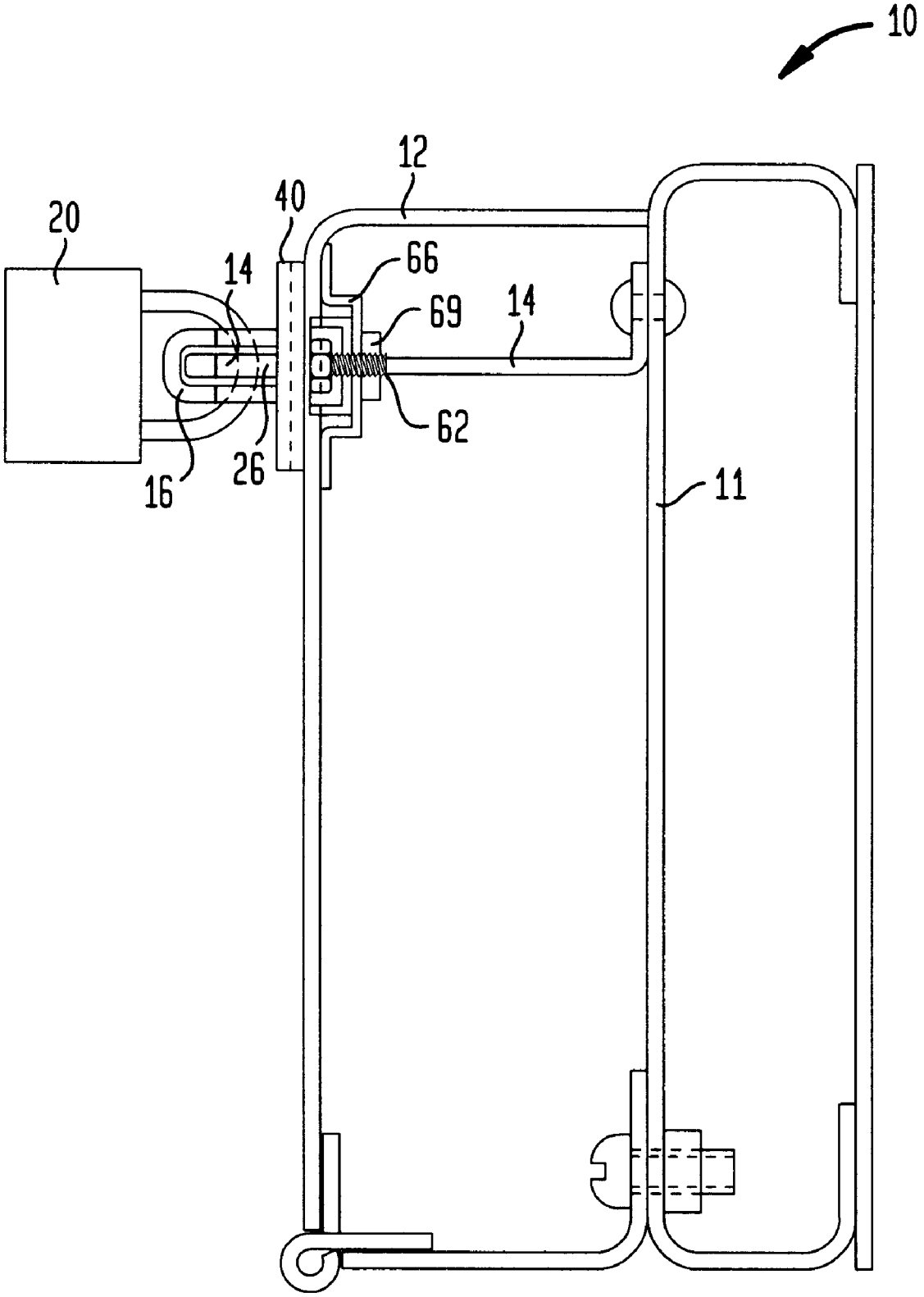
FIG. 3 is a bottom sectional view of the security override system constructed in accordance with a preferred embodiment of the present invention mounted to a utility box and with the system in its closed and locked position, with the lock shown and with the lock rotated 90 degrees for illustration clarity.
Figure 4:
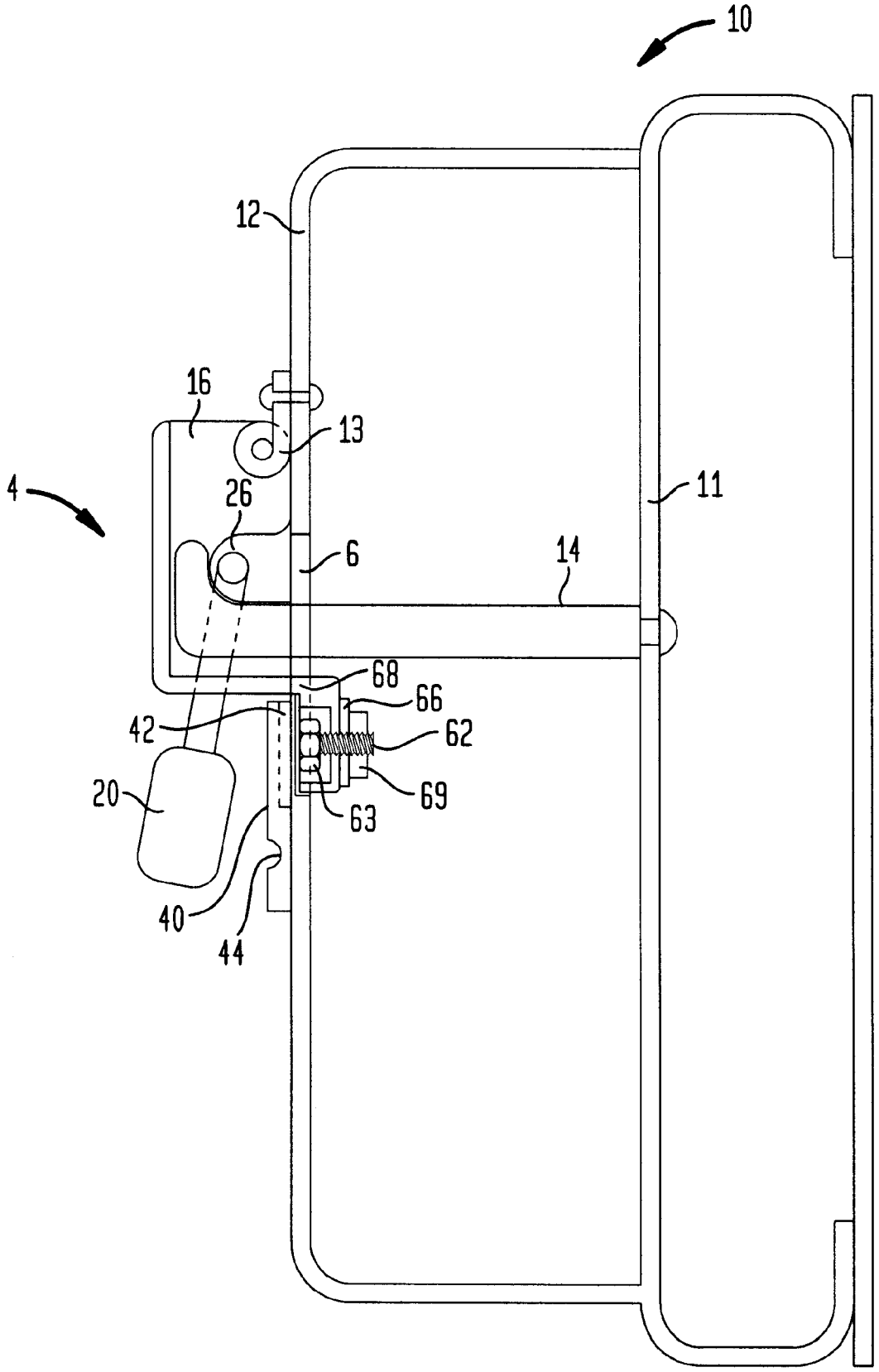
FIG. 4 is a side sectional view of the security override system constructed in accordance with a preferred embodiment of the present invention mounted to a utility box with the system in its closed and locked position.

FIGS. 1 through 6 depict a hinged security override system constructed according to a preferred embodiment of the present invention. The security override system generally includes a fixed one sided hasp portion 14 mounted within a utility box 10 and extending through an opening 6 in outer door 12 of utility box 10. Fixed hasp portion 14 is constructed to mate with a generally U-shaped bracket 16 which is hingeably connected to outer door 12 of utility box 10. Bracket 16 is hingeably movable between an open position and a closed position with respect to the fixed hasp portion 14. When bracket 16 is in its closed position it mates with fixed hasp portion 14 and forms a padlock hasp with an opening 26 therein for insertion of a padlock (FIG. 4). When bracket 16 is in its open position there is a space between bracket 16 and fixed hasp portion 14 such that a locked padlock 20 no longer prevents outer door 12 from being opened (FIG. 6). The hasp portion, bracket, and utility box, can be constructed of any number of materials, such as, by way of a non-limiting example, metal or plastic, or any other material having the necessary rigidity and strength characteristics to perform the functions described herein.

As seen in FIGS. 2A and 2B, bracket 16 is generally U-shaped when viewed from the side (FIG. 2B). Bracket 16 is hingeably mounted to outer door 12 at one end of the "U" by hinge 13, and comprises a fastening portion generally indicated as 60 at the other end. Fastening portion 60 generally comprises a threaded security screw 62 attached to or otherwise mounted within fastening portion 60. Security screw 62 generally comprises a head portion 63 and a threaded shaft portion 65. As seen in FIG. 2B, threaded shaft portion 65 extends through opening 61 in fastening portion 60 and head portion 63 extends into recess 67 of fastening portion 60. In a preferred embodiment, recess 67 is designed so as to accept a tool 70 which surrounds head portion 63 of security screw 62. Opening 61 may also be threaded to aid in maintaining security screw 62 within fastening portion 60. In any event, security screw 62 is turnable within fastening portion 60. As described more fully below, fastening portion 60 is designed to enter recess 68 in outer door 12 when bracket 16 is in its closed position. Bracket 16 is hingeably movable between a closed position (FIG. 4) and an open position (FIG. 6).

As seen in FIG. 3, a fixed hasp portion 14 is fixedly mounted to a rear wall 11 or other surface within the utility box 10 and extends through an opening 6 in outer door 12 of utility box 10. Hasp portion 14 mates with bracket 16 at a point outside of outer door 12 when bracket 16 is in its closed position. Bracket 16 is constructed such that when in its closed position, hasp portion 14 fits under and within bracket 16 to form a complete hasp, generally indicated at 4, having an opening 26 to receive a padlock 20. When outer door 12 is closed and bracket 16 is in its closed position mating with hasp portion 14, padlock 20 is inserted through padlock opening 26 formed thereby. Padlock 20 is therefore between outer door 12 and the mating bracket 16 and hasp portion 14, locking door 12 closed as if by a conventional padlock hasp.

As seen in FIG. 4, hinged bracket 16 is constructed such that when bracket 16 is in its closed position, security screw 62 of fastening portion 60 aligns with a corresponding threaded opening 64 of nut 69 attached or otherwise mounted to a retention plate 66 which is in turn mounted to an inside surface of the outer door 12. In a preferred embodiment, fastening portion 60 extends into a recess, generally indicated as 68 (FIG. 6) in outer door 12 of utility box 10 such that the fastening portion 60 does not extend beyond the front surface of outer door 12. When security screw 62 is threaded into threaded opening 64, the interaction of the security screw 62 with the threaded opening 64 maintains bracket 16 in its closed position. It will be appreciated to one of skill in the art that security screw 62 and retention plate 66, nut 69 and threaded opening 64 could be constructed in a variety of shapes and sizes to facilitate releasable mating interengagement therebetween, and for securely retaining bracket 16 in the closed position. In any event, when security screw 62 is engaged with threaded opening 64, and padlock 20 is installed within opening 26 formed by bracket 16 and hasp 14, it would appear to the ordinary passersby that outer door 12 cannot be opened without first removing padlock 20. However, the security mechanism can be overridden by the technician or building owner knowledgeable in its construction, facilitating opening of outer door 12 without unlocking the padlock.

As seen in FIGS. 4–6, in a preferred embodiment, fastening portion 60 of hinged bracket 16 is hidden from view by the means of a bumper 40 or other type of hinged magnetic label. Bumper 40 is positioned on an outside surface of outer door 12 of utility box 10 so as to movably cover or hide recess 68 which accepts fastening portion 60 and security screw 62. In a preferred embodiment, as seen in FIGS. 4–6, bumper 40 is movable and/or bendable about notch 41 between an extended position (FIG. 4), wherein bumper 40 renders security screw 62 hidden from view from outside the utility box 10, and a bent position (FIGS. 5 and 6), wherein security screw 62 is visible and accessible from outside utility box 10. That is, bumper 40 can be bent or otherwise moved so as to reveal security screw 62 and/or recess 68 and/or fastening portion 60. It will be appreciated to one of skill in the art that bumper 40 could be constructed in a variety of art-recognized shapes and sizes to facilitate movably hiding security screw 62 and or fastening portion 60 without departing from the spirit of the invention. In a preferred embodiment bumper 40 is constructed as a bendable magnetic label. To the ordinary observer, the bumper would appear to be installed as a means of protecting the enclosure from scratching caused by the insertion and removal of the padlock. The bumper may also be imprinted with text to appear as an advertising or other label for the enclosure manufacturer. One of skill in the art will recognize that bumper 40 can be constructed or positioned as in any number of art-recognized fashions as a matter of design choice for providing a means for concealing the fastening portion without departing from the spirit of the present invention. For example, the means for concealing the fastening portion could be a completely removable member, a pivotable member, a swinging member, a screwed on member, a removable magnetic member, or any other device capable of movably concealing the fastening portion. The concealing means could be made of any type of material, such as, by way of a non-limiting example, metal or plastic, or any other material having the necessary rigidity and strength characteristics to perform the functions described herein.

Figure 1:
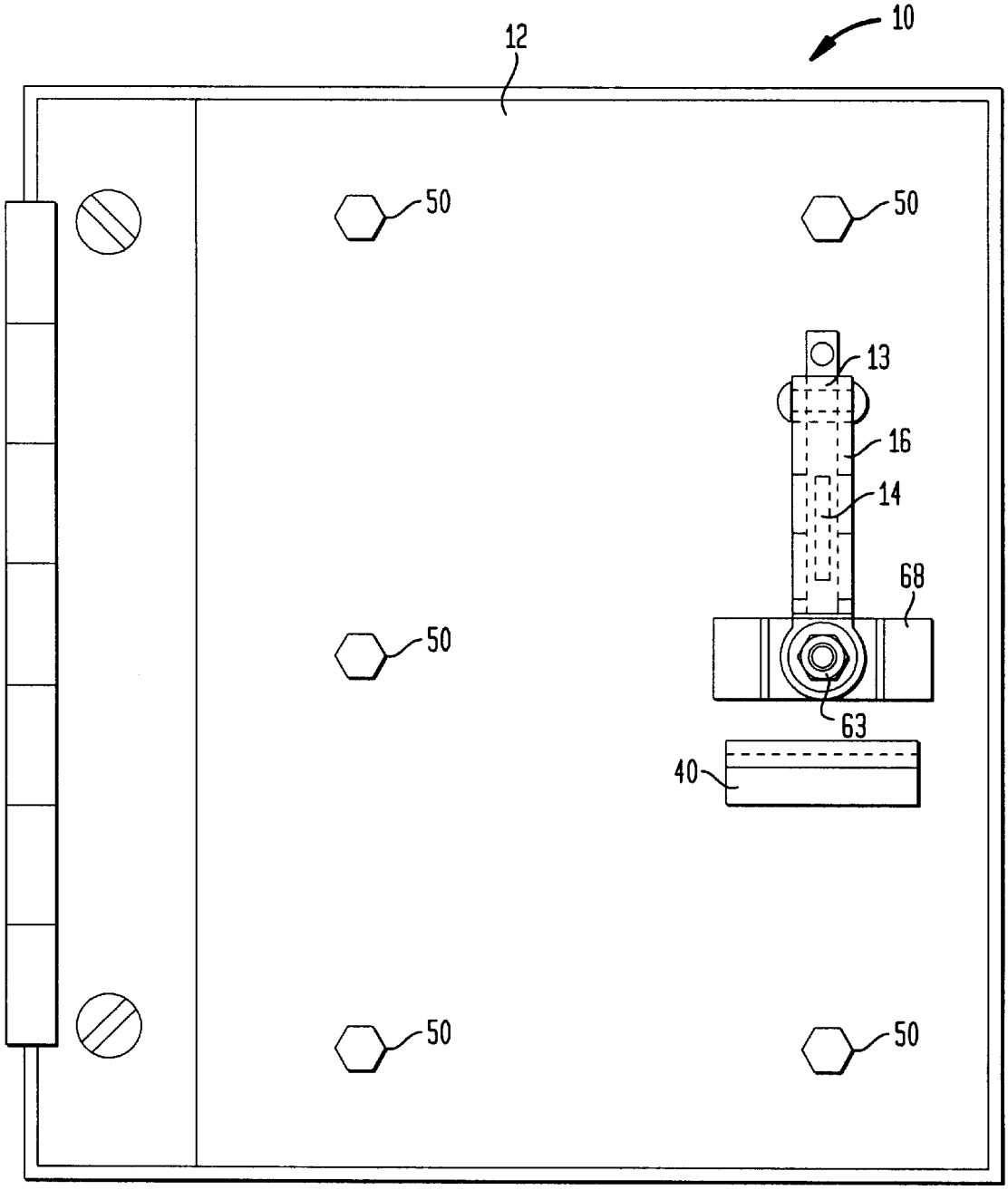
FIG. 1 is a front elevational view of the security override system constructed in accordance with a preferred embodiment of the present invention mounted to a utility box and with the system in its closed and locked position, wherein the padlock has been removed for illustration clarity and wherein the bumper is in its bent position.

One of skill in the art will recognize that while in a preferred embodiment fastening portion 60 is behind the outer surface of outer door 12 when bracket 16 is in its closed position, as a matter of design choice bumper 40 can be constructed with a notch 42 on a backside thereof which could accept a protruding fastening portion 60 and/or head portion 63 of security screw 62, thus requiring a smaller recess 68 and/or eliminating recess 68 all together. To add a further level of security, security screw 62 can be a specialized screw such as, for example, a KS/216 type combination screw, or other type screw known in the art and requiring a special tool to operate it. Also, security screw 62 can be constructed such that to the untrained eye it appears as merely an ordinary screw or bolt serving no apparent hidden purpose. That is, as seen in FIG. 1, outer door 12 of utility box 10 can be constructed with a number of similar or identical looking screws 50 to further maintain the secret function of security screw 62.

In any event, as seen in FIG. 5, once security screw 62 is accessible by bending or otherwise moving bumper 40, by turning security screw 62 with an appropriately constructed tool 70, security screw 62 is unthreaded from the corresponding threaded opening 64 in nut 69 attached to retention plate 66. As seen in FIG. 6, once security screw 62 is fully unthreaded, bracket 16 can then be hingeably moved to its open position, wherein the outer door can be opened. One of skill in the art will recognize that while FIG. 6 depicts padlock 20 being moved along with bracket 16, fastening portion 60 of bracket 16 could be constructed to be small enough such that padlock 20 could be slipped over fastening portion 60 and thus removed from bracket 16. Thus, while the utility box looks as though it cannot be opened without first unlocking the padlock, the technician knowledgeable in its construction can open the utility box without unlocking the padlock. Also, should the key to the padlock become lost, the building owner can open the utility box without having to cut off the padlock.

When the technician has completed servicing of the utility box, outer door 12 can be closed and re-locked without having to first unlock the padlock. That is, once the technician has completed his work, the technician closes outer door 12, and then moves bracket 16 back to its closed position. The technician then turns security screw 62 thereby threading security screw 62 into threaded opening 64, thus maintaining bracket 16 in its closed position.

Thus, while the utility box looks as though it cannot be opened without unlocking the padlock, a technician or other user knowledgeable in its construction can open the utility box without first unlocking the padlock. Also, the technician can close the utility box when he is completed without having to first unlock the padlock. Should the key to the padlock become lost, the building owner or other authorized user can open the utility box without having to cut off the padlock. Moreover, while the invention set forth herein is generally described in connection with a junction box or other like enclosure, the person of skill will recognize from the teachings herein that the present invention may be applied to any padlocked door, compartment, enclosure or any other structure requiring securement with a padlock and hasp, or the invention may be adapted to a hasp which may mount to a variety of structures.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A security override system for a lockable enclosure comprising:

a hasp portion adapted to be mounted to an enclosure and adapted to extend through an opening in an outer door of said enclosure;

a bracket adapted to be mounted to said outer door, said bracket being movable between an open position and a closed position, said bracket having a fastening portion attached at one end thereof;

said bracket mating with said hasp portion when in said closed position for forming a padlock receiving portion;

said fastening portion being constructed and positioned to releasably engage a corresponding retention member adapted to be mounted within said enclosure when said bracket is in said closed position;

said bracket being immovable when said fastening portion is engaged with said retention member, said bracket being movable when said fastening portion is not engaged with said retention member to thereby open said padlock receiving portion.

2. The security override system according to claim 1, further comprising a bumper adapted to be attached to said outer door, said bumper being movable between an extended position wherein said bumper renders said fastening portion hidden from view from outside said enclosure, and a bent position wherein said fastening portion is visible from outside said enclosure.

3. The security override system according to claim 2, wherein said fastening portion can be disengaged from said retention member when said bumper is in said bent position to thereby move said bracket to its open position and thereby open said outer door.

4. The security override system according to claim 1, wherein said fastening portion comprises a KS/216 type combination screw.

5. The security override system according to claim 1, wherein said retention member comprises a threaded opening.

6. The security override system according to claim 1, wherein said bracket is adapted to be hingeably mounted to said outer door.

7. The security override system according to claim 1, wherein said bracket is generally U-shaped and said hasp portion has a generally L-shaped end which mates beneath and within said bracket such that a locked padlock cannot be removed from said padlock receiving portion when said bracket is in said closed position and said fastening portion is engaged without first unlocking the padlock.

8. The security override system according to claim 1, wherein said system is adapted to be mounted to an enclosure that is a Building Entrance Protector.

9. The security override system of claim 2, wherein said bumper is bendable about a notch in an outside surface thereof.

10. The security override system of claim 2, wherein said fastening portion does not extend beyond an outer surface of said outer door when said bracket is in said closed position.

11. The security override system of claim 2, wherein said bumper has a notch on an inside surface thereof.

12. The security override system of claim 11, wherein said notch accepts at least a portion of said fastening portion.

13. The security override system of claim 1, further comprising a means for concealing said fastening portion.

14. The security override system of claim 13, wherein said concealing means is movable to reveal said fastening portion.

15. The security override system of claim 14, wherein said concealing means is removable.

16. The security override system of claim 15, wherein said concealing means is a magnetic label.

* * * * *